US008840433B2

(12) United States Patent
Ho et al.

(10) Patent No.: US 8,840,433 B2
(45) Date of Patent: Sep. 23, 2014

(54) ELECTRICAL CONNECTOR

(71) Applicant: Lotes Co., Ltd, Keelung (TW)

(72) Inventors: Der Yu Ho, Keelung (TW); You Hua Cai, Keelung (CN)

(73) Assignee: Lotes Co., Ltd, Keelung (TW)

( * ) Notice: Subject to any disclaimer, the term of this patent is extended or adjusted under 35 U.S.C. 154(b) by 23 days.

(21) Appl. No.: 13/892,848

(22) Filed: May 13, 2013

(65) Prior Publication Data

US 2014/0220826 A1 Aug. 7, 2014

(30) Foreign Application Priority Data

Feb. 7, 2013 (CN) ..... 2013 2 0070667 U

(51) Int. Cl.
*H01R 24/28* (2011.01)
*H01R 12/00* (2006.01)
*H01R 4/02* (2006.01)

(52) U.S. Cl.
CPC ..... *H01R 4/02* (2013.01)
USPC ..... 439/626; 439/74; 439/660

(58) Field of Classification Search
CPC ..... H01R 13/514; H01R 11/32; H01R 12/57; H01R 4/02; H01R 23/6886
USPC ..... 439/74, 83, 626, 660
See application file for complete search history.

(56) References Cited

U.S. PATENT DOCUMENTS 4,872,846 A * 10/1989 Clark ..... 439/83
5,090,116 A * 2/1992 Henschen et al. ..... 29/827
5,281,166 A * 1/1994 Yu et al. ..... 439/571
5,299,939 A * 4/1994 Walker et al. ..... 439/74
5,453,017 A * 9/1995 Belopolsky ..... 439/83
5,904,581 A * 5/1999 Pope et al. ..... 439/74
6,402,574 B2 * 6/2002 Cachina et al. ..... 439/876
6,551,117 B2 * 4/2003 Poplawski et al. ..... 439/92
6,896,526 B2 * 5/2005 Pitzele ..... 439/83
7,195,495 B2 * 3/2007 Takano et al. ..... 439/74
8,235,733 B2 * 8/2012 Yamashiro et al. ..... 439/83
2006/0194458 A1 * 8/2006 Miyazaki ..... 439/83
2007/0020967 A1 * 1/2007 Midorikawa ..... 439/74
2008/0305657 A1 * 12/2008 Midorikawa ..... 439/74
2010/0068900 A1 * 3/2010 Wu et al. ..... 439/74
2011/0097936 A1 * 4/2011 Hirata ..... 439/626
2012/0164855 A1 * 6/2012 Zhang et al. ..... 439/83

* cited by examiner

*Primary Examiner* — Briggitte R Hammond

(74) *Attorney, Agent, or Firm* — Morris, Manning & Martin LLP; Tim Tingkang Xia, Esq.

(57) ABSTRACT

An electrical connector includes a body, a soldering portion, an insertion arm, a through hole, and a conductive layer. The soldering portion is disposed on the body. The insertion arm protrudes from the body, and has at least one contact portion. The through hole is formed in the body. One end of the through hole is connected to the soldering portion, and the other end of the through hole is formed through the insertion arm. The conductive layer extends along an inner wall of the through hole from the soldering portion to the insertion arm, and connects the contact portion. The conductive layer is disposed on the body and the insertion arm to achieve an electrical contact effect. Since the body and the insertion arm are conducted through the conductive layer in the through hole, the electrical connector is easy-to-manufacture without requiring assembly of terminals.

11 Claims, 6 Drawing Sheets

ELECTRICAL CONNECTOR

CROSS-REFERENCE TO RELATED APPLICATION

This non-provisional application claims priority under 35 U.S.C. §119(a) on Patent Application No. 201320070667.X filed in P.R. China on Feb. 7, 2013, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an easy-to-manufacture electrical connector.

BACKGROUND OF THE INVENTION

Currently, terminals at a male end of an electrical connector are generally formed by stamping a metal plate. The terminals formed by stamping are electroplated, and then assembled to an insulating body manually or by machine, so as to form an electrical connector. This process requires the step of assembling terminals, increasing the complexity of the manufacturing process of the electrical connector.

Therefore, it is necessary to design an improved electrical connector to solve the above problems.

SUMMARY OF THE INVENTION

In one aspect, the present invention is directed to an easy-to-manufacture electrical connector.

In one embodiment, the present invention includes a body, a soldering portion, an insertion arm, a through hole, and a conductive layer. The soldering portion is disposed on the body. The insertion arm protrudes from the body, and has at least one contact portion. The through hole is formed in the body. One end of the through hole is connected to the soldering portion, and the other end of the through hole is formed through the insertion arm. The conductive layer extends along an inner wall of the through hole from the soldering portion to the insertion arm, and connects to the contact portion.

In certain embodiments, the through hole is used for receiving an excess of a solder material caused by wicking during soldering.

In certain embodiments, the insertion arm has an end portion disposed opposite to the body and a first side and a second side that are disposed neighboring to the end portion and opposite to each other. The first side and the second side are each provided with the contact portion.

In certain embodiments, the through hole has a first opening and a second opening. The first opening is formed at the soldering portion, and the second opening is formed at the end portion.

In certain embodiments, the through hole has the first opening and the second opening. The first opening is formed at the soldering portion, and the second opening is formed at the insertion arm. A transition portion is disposed between the second opening and the contact portion, and the conductive layer extends to cover the transition portion.

In certain embodiments, a distance from the second opening to the body is greater than a distance from the contact portion to the body.

In certain embodiments, the conductive layer extends to cover the soldering portion and the contact portion.

In certain embodiments, at least one of the soldering portion and the contact portion is provided with a metal sheet.

In certain embodiments, an insulating isolation region is formed between the soldering portion and the contact portion.

In certain embodiments, an anti-wicking barrier is disposed on the conductive layer. The through hole is filled up with the conductive layer.

As compared with the related art, among other things, the embodiments of the present invention have the following beneficial effects.

The through hole is formed in the body. One end of the through hole is connected to the soldering portion, and the other end of the through hole is formed through the insertion arm. The conductive layer extends along the inner wall of the through hole from the soldering portion to the insertion arm, and is connected to the contact portion. The conductive layer is disposed on the body and the insertion arm to achieve an electrical contact effect. Since the body and the insertion arm are conducted through the conductive layer in the through hole, the electrical connector is easy-to-manufacture without requiring assembly of terminals.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
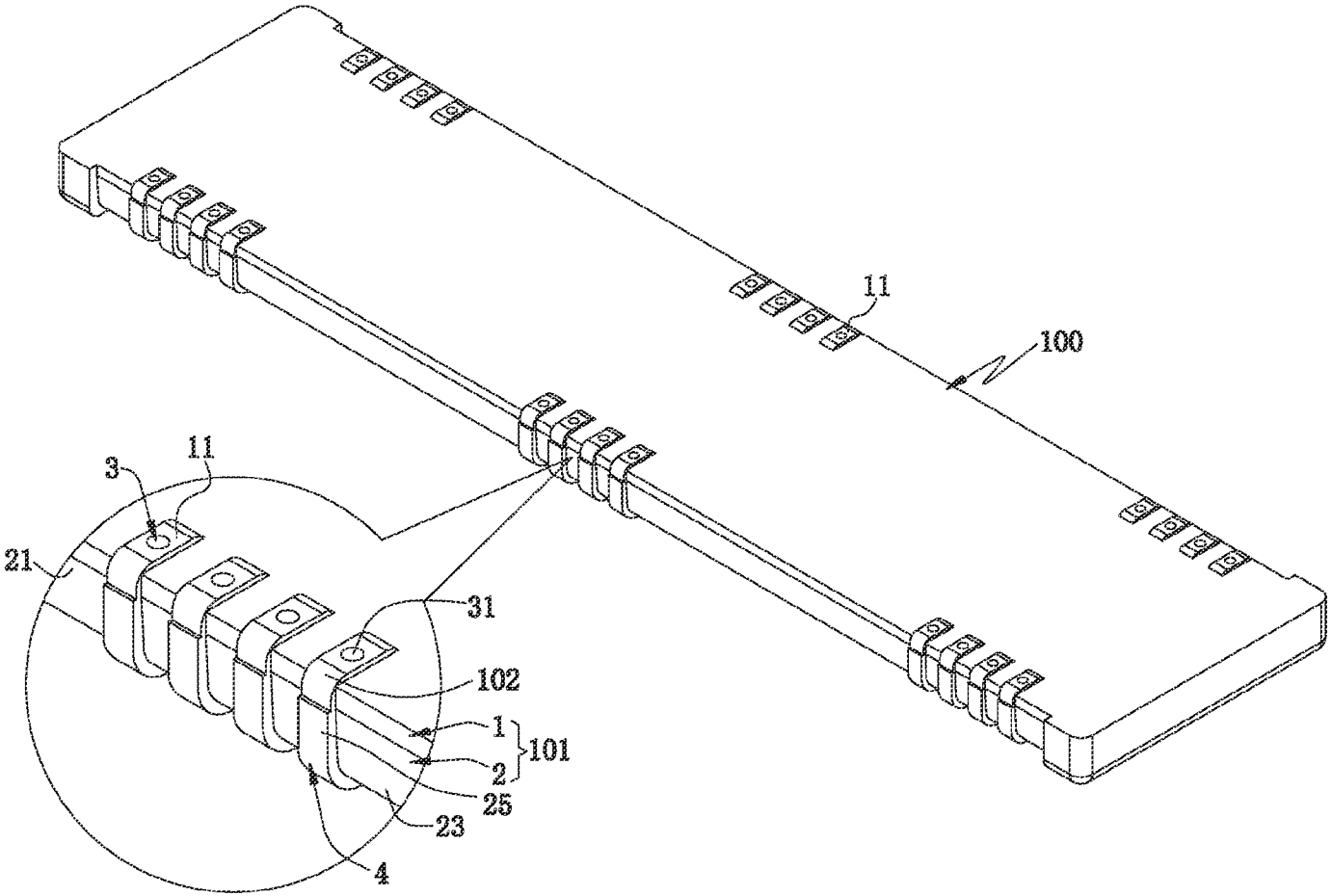
FIG. 1 is a schematic three-dimensional view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 2:
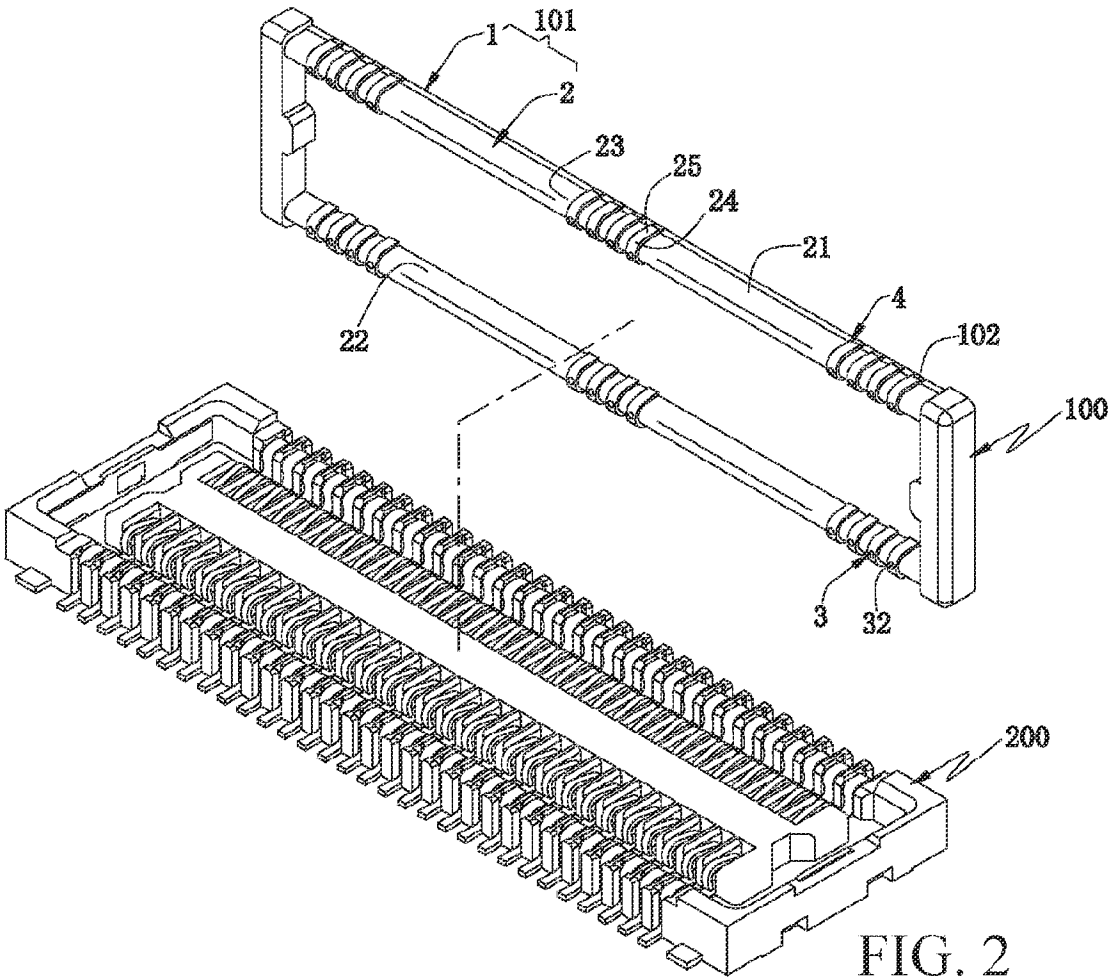
FIG. 2 is a schematic three-dimensional exploded view of an electrical connector and a female connector according to one embodiment of the present invention.

Referring to FIG. 1 and FIG. 2, an electrical connector 100 according to one embodiment of the present invention has an insulating housing 101. The insulating housing 101 includes a body 1 and a plurality of insertion arms 2 protruding downward from the body 1 to form a U-shape. Each of the insertion arms 2 has an end portion 23 opposite to the body 1, and a first side 21 and a second side 22 that are disposed neighboring to the end portion 23 and opposite to each other. A soldering portion 11 is disposed on the body 1. The first side 21 and the second side 22 of the insertion arm 2 respectively have a contact portion 25. In other embodiments, the contact portion 25 may be provided on the first side 21 or the second side 22 only.

Referring to FIG. 1, both the soldering portion 11 and the contact portion 25 are formed by a conductive layer 4. An insulating isolation region 102 is formed between the soldering portion 11 and the contact portion 25. The conductive layer 4 is not disposed on the insulating isolation region 102 so as to prevent direct contact and conduction between the soldering portion 11 and the contact portion 25. The conductive layer 4 may be formed by electroplating, laser or other physical or chemical methods. In other embodiments, the soldering portion 11 and the contact portion 25 may each be embedded with a metal sheet (not shown), or one of the soldering portion 11 and the contact portion 25 may be embedded with a metal sheet. In another embodiment, other methods may be used as long as an electrical conduction effect can be achieved between the soldering portion 11 and the contact portion 25.

Figure 4:
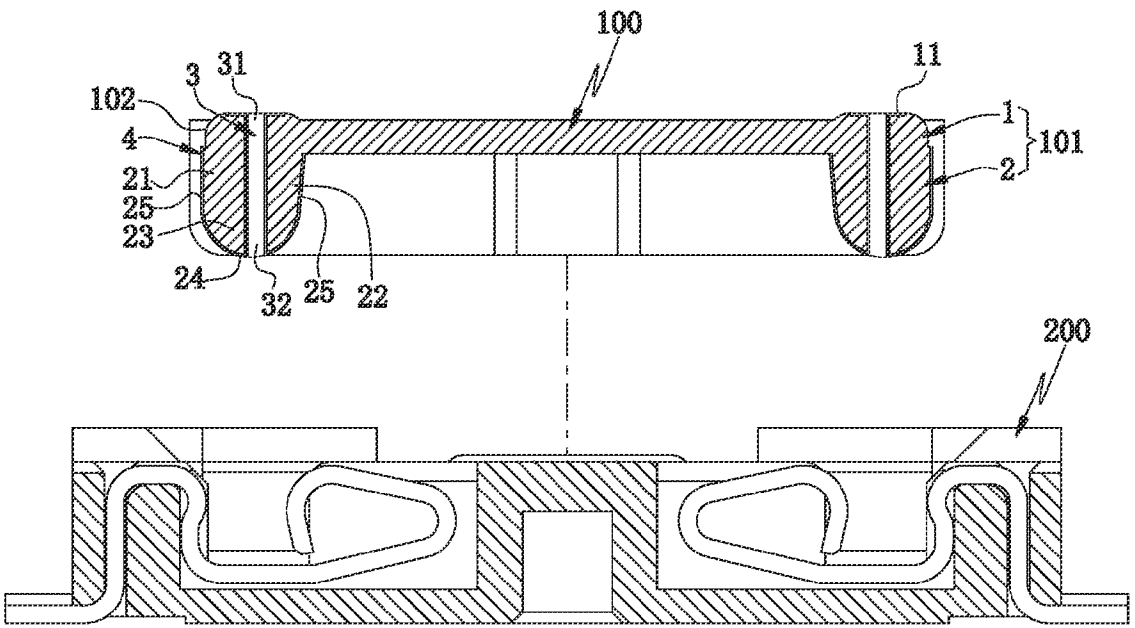
FIG. 4 is a schematic exploded sectional view of an electrical connector and a female connector according to one embodiment of the present invention.
Figure 6:
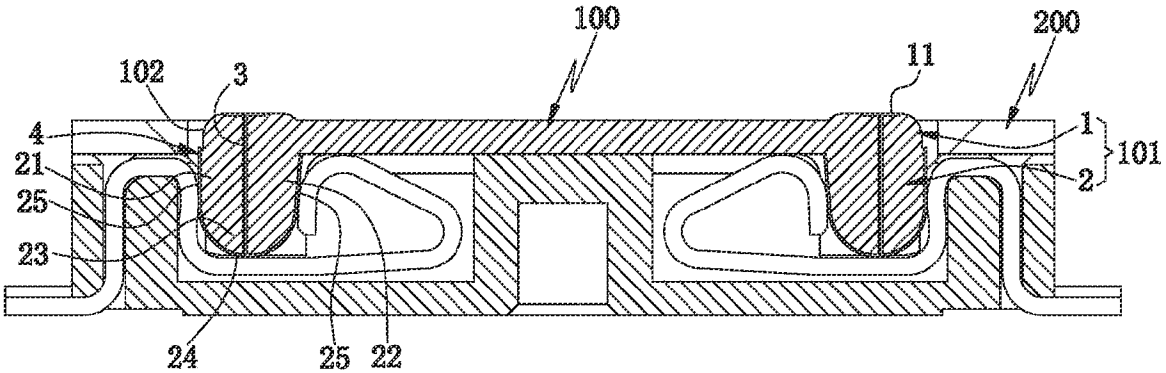
FIG. 6 is a schematic assembled sectional view of an electrical connector and a female connector when the through hole is filled up with the conductive layer according to one embodiment of the present invention.

Referring to FIG. 2 and FIG. 4, a through hole 3 is recessed downward from the body 1 and formed through the insertion arm 2. The through hole 3 is formed by laser. The through hole 3 has a first opening 31 and a second opening 32. The first opening 31 is connected to the soldering portion 11. The second opening 32 is formed at the end portion 23. Therefore, a distance from the second opening 32 to the body 1 is greater than a distance from the contact portion 25 to the body 1, so that the through hole 3 has a sufficient length. In other embodiments, the second opening 32 may be closer to the body 1 than the contact portion 25 is. A transition portion 24 is disposed between the second opening 32 and the contact portion 25. The transition portion 24 can solve the problem that the opening affects the contact performance of the contact portion 25. The conductive layer 4 is disposed on an inner wall of the through hole 3. In other embodiments, if the through hole 3 has a small diameter, the conductive layer 4 may directly block the through hole 4 to prevent a molten solder material from climbing upward during soldering, thereby preventing wicking. Alternatively, an anti-wicking barrier is disposed on the conductive layer 4 in the through hole 3. The anti-wicking barrier may be a hydrophobe. In certain embodiments, the anti-wicking barrier may be disposed at any position in the conduction path between the contact portion 25 and the soldering portion 11, as long as wicking can be prevented. Alternatively, referring to FIG. 6, the through hole 3 is filled up with the conductive layer 4, that is, the through hole 3 is completely blocked by the conductive layer 4, thereby preventing wicking The conductive layer 4 is also disposed on the transition portion 24, and the soldering portion 11 is electrically conducted with the contact portion 25 through the conductive layer 4 on the inner wall of the through hole 3 and the conductive layer 4 on the transition portion 24.

Figure 3:
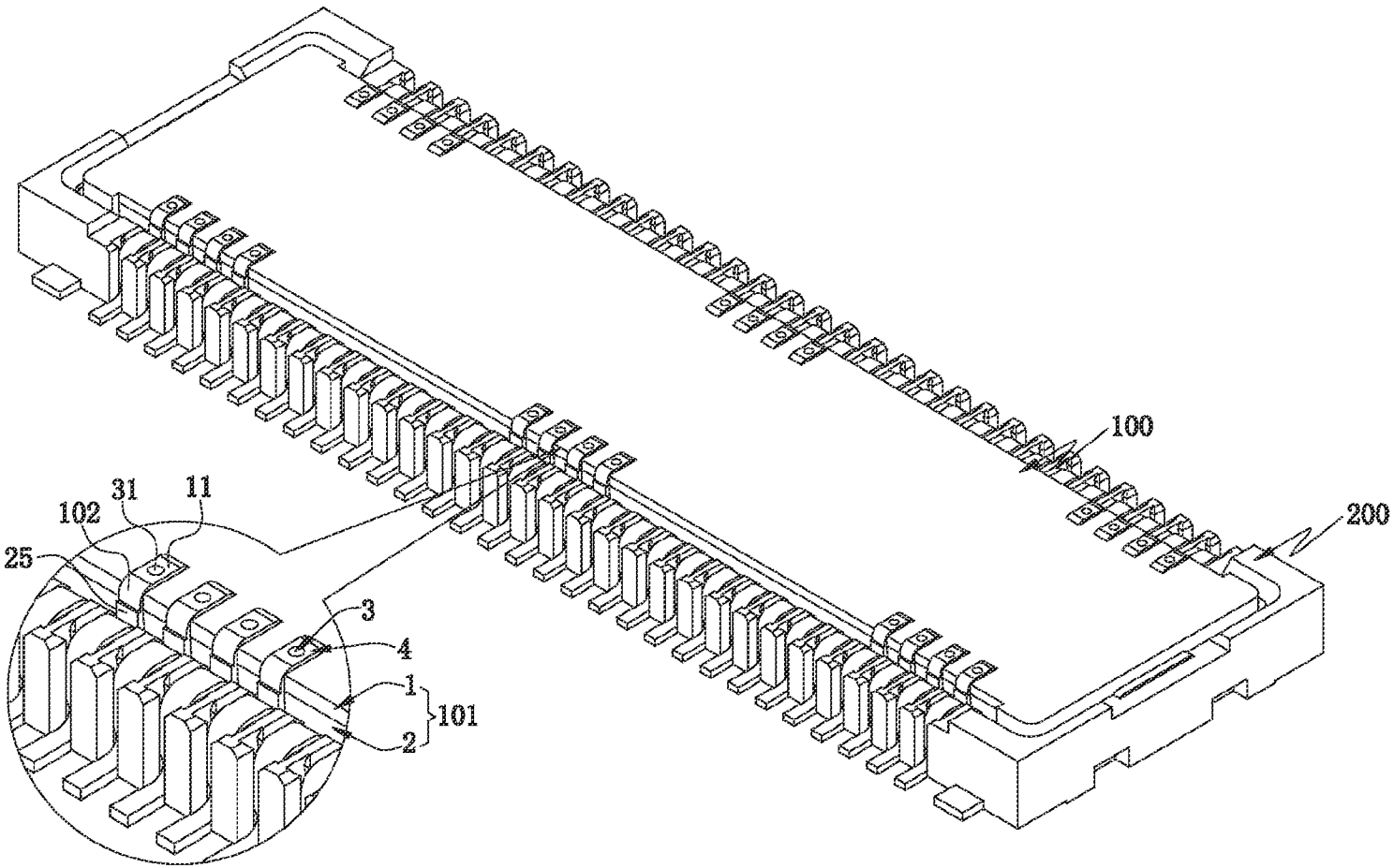
FIG. 3 is a schematic three-dimensional assembled view of an electrical connector and a female connector according to one embodiment of the present invention.

Referring to FIGS. 1-3, during manufacturing, the body 1 and the insertion arm 2 are correspondingly electroplated with the conductive layer 4, and the conductive layer 4 extends along the inner wall of the through hole 3 from the soldering portion 11 to the insertion arm 2, covers the transition portion 24, and further covers and is connected to the contact portion 25, so as to achieve electrical conduction therebetween. Compared with conventional electrical connectors that require assembling terminals formed by stamping to a body to achieve electrical conduction, the design of the present invention does not require the step of assembling terminals, thereby simplifying the manufacturing process. Furthermore, the electrical connector 100 achieves electrical conduction through the conductive layer 4, and the conductive layer 4 is thinner than ordinary metal terminals, so that the overall height of the electrical connector 100 can be reduced to some extent, thereby facilitating miniaturization of the electrical connector 100.

Referring to FIG. 4, when the electrical connector 100 is soldered to a circuit board (not shown), the solder material is melt at a high temperature during soldering. Since the insulating isolation region 102 is formed between the soldering portion 11 and the contact portion 25 and the conductive layer 4 is not disposed on the insulating isolation region 102, the molten solder material will not directly climb from the soldering portion 11 to the contact portion 25 to affect the contact effect. The molten solder material will climb upward along the through hole 3, and after climbing to a certain extent, the molten solder material will block the through hole 3, so that the wicking stops. Therefore, the problem that the molten solder material climbs to the contact portion 25 to affect the contact performance of the contact portion 25 is well solved. Preferably, the through hole 3 has a sufficient length and the through hole 3 has a diameter as small as possible, thereby better preventing wicking.

Figure 5:
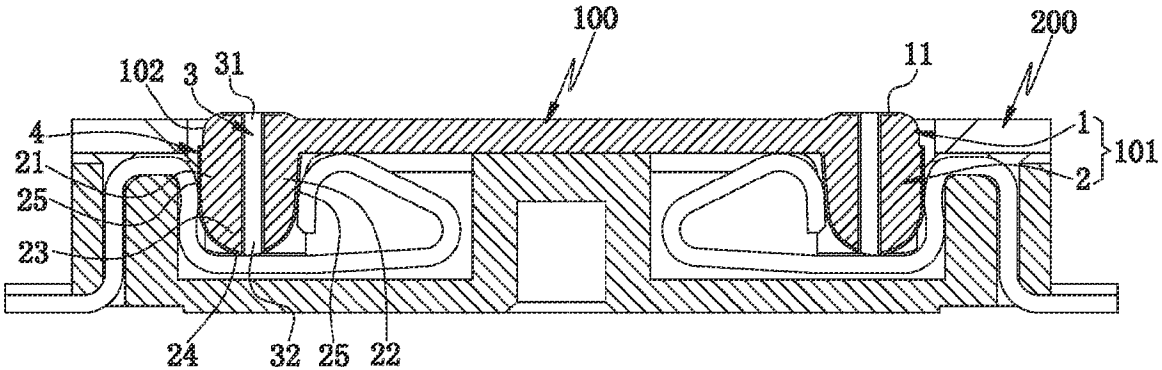
FIG. 5 is a schematic assembled sectional view of an electrical connector and a female connector according to one embodiment of the present invention.

Referring to FIGS. 3-5, when the electrical connector 100 is mated to a female connector 200, the contact portions 25 contact terminals (not marked) of the female connector 200, thereby implementing signal transmission between the electrical connector 100 and the female connector 200.

Based on the above, the electrical connector 100 according to the embodiments of the present invention, among other things, has the following advantages.

1. The electrical connector 100 achieves an electrical contact effect through the conductive layer 4 disposed on the body 1 and the insertion arm 2, which does not require the step of assembling terminals, thereby effectively simplifying the manufacturing process of the electrical connector 100.

2. The electrical connector 100 achieves electrical conduction through the conductive layer 4, and the conductive layer 4 is thinner than ordinary metal terminals, so that the overall height of the electrical connector 100 can be reduced to some extent, thereby facilitating miniaturization of the electrical connector 100.

3. The insulating isolation region 102 is formed between the soldering portion 11 and the contact portion 25, and the conductive layer 4 is not disposed on the insulating isolation region 102, so that when the solder material is melt at a high temperature during soldering, the molten solder material will not directly climb from the soldering portion 11 to the contact portion 25 to affect the contact effect. The molten solder material will climb upward along the through hole 3, and after climbing to a certain extent, the molten solder material will block the through hole 3, so that the wicking stops. Therefore, the problem that the molten solder material climbs to the contact portion 25 to affect the contact performance of the contact portion 25 is well solved. Preferably, the through hole 3 has a sufficient length and the through hole 3 has a diameter as small as possible, thereby better preventing wicking.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a body;

a soldering portion, disposed on the body;

an insertion arm, protruding from the body, and having at least one contact portion;

a through hole, formed in the body, one end of the through hole being connected to the soldering portion, and the other end of the through hole being formed through the insertion arm; and a conductive layer, extending along an inner wall of the through hole from the soldering portion to the insertion arm, and connecting to the contact portion.

2. The electrical connector according to claim 1, wherein the through hole is adapted for receiving an excess of a solder material caused by wicking during soldering.

3. The electrical connector according to claim 1, wherein the insertion arm has an end portion disposed opposite to the body, and a first side and a second side that are disposed neighboring to the end portion and opposite to each other, and wherein the first side and the second side are each provided with the contact portion.

4. The electrical connector according to claim 3, wherein the through hole has a first opening and a second opening, the first opening being formed at the soldering portion, and the second opening being formed at the end portion.

5. The electrical connector according to claim 1, wherein the through hole has a first opening and a second opening, the first opening is formed at the soldering portion, the second opening is formed at the insertion arm, a transition portion is disposed between the second opening and the contact portion, and the conductive layer extends to cover the transition portion.

6. The electrical connector according to claim 5, wherein a distance from the second opening to the body is greater than a distance from the contact portion to the body.

7. The electrical connector according to claim 1, wherein the conductive layer extends to cover the soldering portion and the contact portion.

8. The electrical connector according to claim 1, wherein at least one of the soldering portion and the contact portion is provided with a metal sheet.

9. The electrical connector according to claim 1, wherein an insulating isolation region is formed between the soldering portion and the contact portion.

10. The electrical connector according to claim 1, wherein an anti-wicking barrier is disposed on the conductive layer.

11. The electrical connector according to claim 1, wherein the through hole is filled up with the conductive layer.

* * * * *